US006314775B2

(12) United States Patent
Schwab

(10) Patent No.: US 6,314,775 B2
(45) Date of Patent: Nov. 13, 2001

(54) FLAT KEY

(75) Inventor: Dittmar Schwab, Rodgau (DE)

(73) Assignee: Valeo GmbH & Co. Schliessysteme KG, Neuss (DE)

( * ) Notice: Subject to any disclaimer, the term of this patent is extended or adjusted under 35 U.S.C. 154(b) by 0 days.

(21) Appl. No.: 09/729,706

(22) Filed: Dec. 6, 2000

(30) Foreign Application Priority Data

Dec. 7, 1999 (DE) ..... 199 58 819

(51) Int. Cl.[7] ..... A47G 29/10
(52) U.S. Cl. ..... 70/456 R; 70/408
(58) Field of Search ..... 70/395, 408, 456 R

(56) References Cited

U.S. PATENT DOCUMENTS

| | | | | |
|---|---|---|---|---|
| 2,514,940 | * | 7/1950 | Doss et al. | 70/456 R X |
| 2,547,524 | * | 4/1951 | Gross | 70/456 R |
| 2,550,375 | * | 4/1951 | Pentek | 70/456 R |
| 2,566,118 | * | 8/1951 | Corwin et al. | 70/456 R |
| 2,567,816 | * | 9/1951 | Kniebes | 70/456 R |
| 2,608,851 | * | 9/1952 | Leff | 70/456 R |
| 2,822,684 | * | 2/1958 | Ray | 70/456 R |
| 3,313,137 | * | 4/1967 | Maier | 70/456 R |
| 3,328,986 | * | 7/1967 | Ralton | 70/456 R |
| 3,427,834 | * | 2/1969 | Tutino | 70/456 R X |
| 3,605,464 | * | 9/1971 | Ostrager | 70/456 R X |
| 3,613,414 | * | 10/1971 | Ostrager | 70/456 R X |
| 3,672,192 | * | 6/1972 | Dontas | 70/456 R X |
| 3,696,649 | * | 10/1972 | Chow et al. | 70/456 R |
| 4,281,458 | * | 8/1981 | Okada | 30/162 |
| 4,660,397 | * | 4/1987 | Girimont | 70/456 R |
| 5,460,022 | * | 10/1995 | Parsons | 70/456 R |

* cited by examiner

*Primary Examiner*—Suzanne Dino Barrett
(74) *Attorney, Agent, or Firm*—Liniak, Berenato, Longacre & White

(57) ABSTRACT

A flat key having a grip element (2) and a key bit (3), the grip element (2) including a casing (4) and the key bit (3) being arranged in a manner enabling it to be moved into and out of the grip element casing (4) and to be fixed in its respective extreme position. In order to provide a flat key (1) with an axially displaceable key bit (3) which has an inexpensively manufactured drive and requires relatively small dimensions, a spring (7)—preferably a scroll spring—is disposed as the drive in the grip element casing (4), the two end zones (8, 9) of said spring each being wound spirally onto two holders (10, 11) arranged at the side of the key bit (3). The central zone (12) of the spring (7) rests against a support (13) on the end of the key bit (3) that is situated inside the grip element casing (4), with the usual result that when the key bit (3) is inserted into the grip element casing (4) the spring (7) becomes uncoiled from the holders (10, 11) and thus tensioned.

10 Claims, 3 Drawing Sheets

FLAT KEY

BACKGROUND OF THE INVENTION

The invention relates to a flat key having a grip element and a key bit, the grip element including a casing and the key bit being arranged in a manner enabling it to be moved into and out of the grip element casing and to be fixed in its respective extreme position.

Flat keys of this type have the advantage that they take up relatively little space and that when being carried, for example in a jacket or trouser pocket, there is less risk of injury than is the case with flat keys having a key bit that is rigidly fixed on the grip element.

DESCRIPTION OF THE PRIOR ART

Normally in the case of the conventional flat keys of the prior art, the key bit is folded out from the grip element casing via a rotary spring, and swivelled into the grip element casing against the pressure of the rotary spring. The key bit is secured in the respective extreme position by means of a push-button arranged on the grip element.

The drawbacks of these known flat keys include the fact that as a rule it is necessary to use two hands to fold down the key bit. In addition, the key bit requires a relatively large swivel radius when swivelling it in and out, which means that problems can frequently arise if the key bit is swivelled out by inadvertently operating the push-button whilst the key is in the jacket or trouser pocket, etc. It is also easy for fingers to become jammed when swivelling in the key bit.

From German Patent Application No. 199 12 749. 2, which is not a prior publication, a flat key is already known on which the key bit is mounted in the grip element casing in an axially displaceable manner. The key bit is displaced on the one hand with the aid of a gearwheel disposed on a head element of the key bit, which gearwheel engages in teeth integral with the casing and extending in the direction of the key's longitudinal axis, and on the other hand with the help of a spring which pushes the key bit into its withdrawn extreme position and which is pretensioned by pushing the key bit into the grip element casing.

The primary disadvantage of this flat key is the fact that the drive consisting of the gearwheel, the teeth and the spring is relatively expensive to make and takes up a lot of space.

SUMMARY OF THE INVENTION

It is the object of the invention to provide a flat key having an axially displaceable key bit which has an inexpensively manufactured drive and relatively small dimensions.

In accordance with the invention this object is achieved by the features of claim 1. The subsidiary claims disclose additional, particularly advantageous embodiments of the invention.

The invention is essentially based on the concept of arranging, as the drive in the grip element casing, a spring whose two end zones are each wound spirally onto two holders (cores) disposed at the side of the key bit. The central zone of the spring rests on a support on the end of the key bit that is situated inside the grip element casing, with the result that when the key bit is inserted into the grip element casing the spring is uncoiled from the cores and is thus tensioned.

The spring may be a flat coil spring, the ends of which are respectively joined to the cores. However, in practice it has proved more advantageous to use scroll springs rather than standard flat coil springs, the ends of the scroll springs not being gripped (i.e. not rigidly joined to the barrel core). Springs of this type allow relatively flat spring load deflection curves to be achieved, with the result that even where the key bit has a long displacement path a uniform force operates thereon.

It has also proved to be advantageous if the cores are in the form of rollers against which the key bit rests laterally and is thus guided in its movement into and out of the grip element casing, since if the flat key is configured in this manner only minor friction forces occur between the key bit and the grip element casing. The rollers should be made of rubber or plastic, at least in those zones in which the key bit rests against them.

In one embodiment of the invention the support for the key bit consists of a peg-shaped element about which the central zone of the scroll spring is externally guided. The peg-shaped element engages positively by its end remote from the key bit into a slot-shaped recess extending longitudinally down the key, with the result that the key bit is guided axially in a corresponding fashion during its displacement.

To secure the key bit in its two extreme positions, the peg-shaped element incorporates a recess in which is mounted a displaceably arranged, spring-loaded pin which in the two extreme positions of the key bit engages positively in a corresponding recess in the grip element casing. To release the fixing of the key bit, at least one actuating element adapted to be pressed from outside is arranged on the grip element, said actuating element operating on the pin in such a way that when pressure is exerted on the actuating element the pin is pushed out of the respective recess in the grip element casing and into the recess in the peg-shaped element and thus the key bit can subsequently be displaced axially.

BRIEF DESCRIPTION OF THE DRAWINGS

Further details and advantages of the invention will become clear on reading the detailed description below of a preferred embodiment, taken only as a non-limitative exam making reference to the attached drawings of which.

DETAILED DESCRIPTION OF A PREFERRED EMBODIMENT

Figure 1:
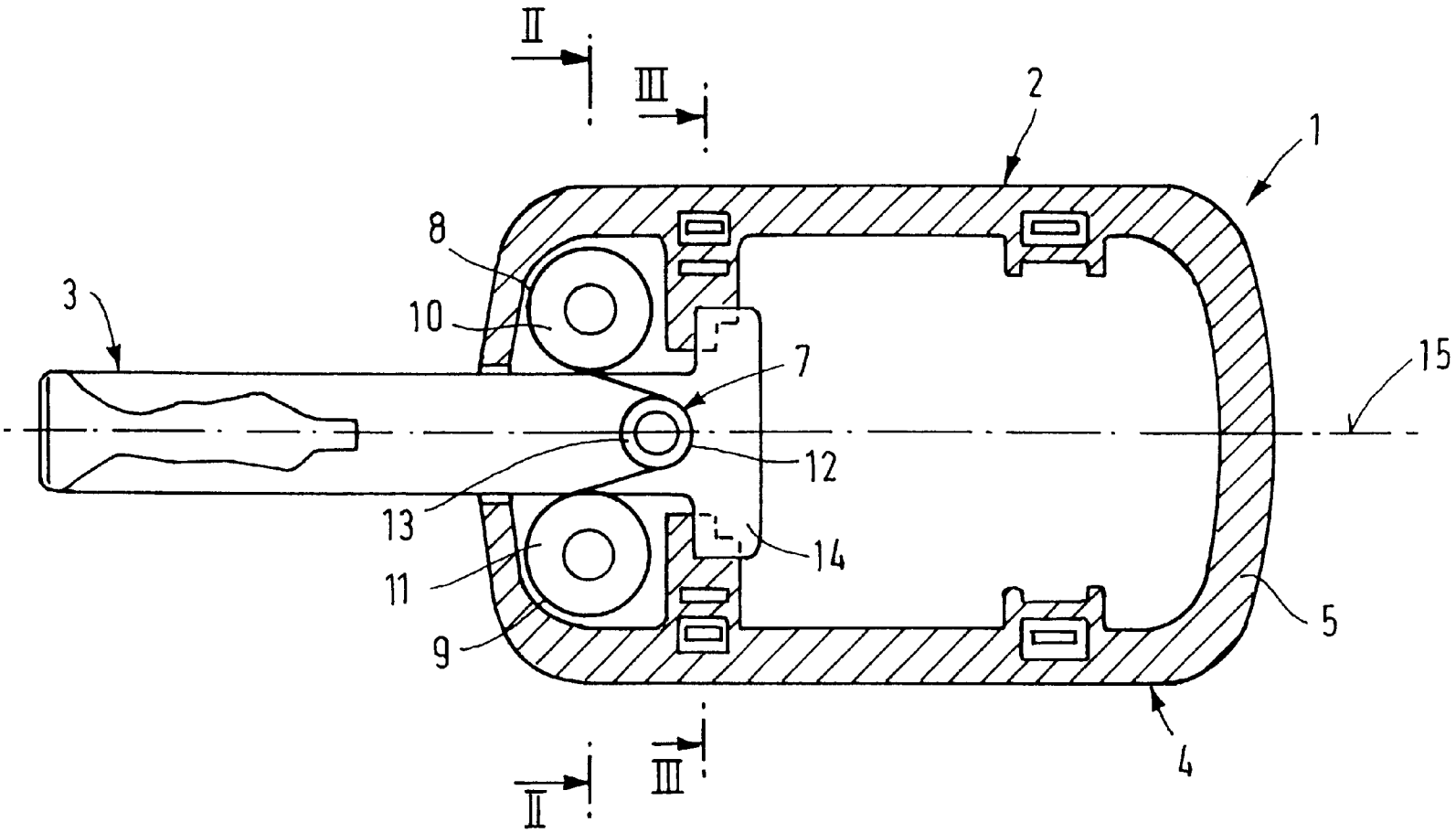
FIG. 1 is a longitudinal section through a flat key in accordance with the invention, with the key bit situated in its extended extreme position.
Figure 2:
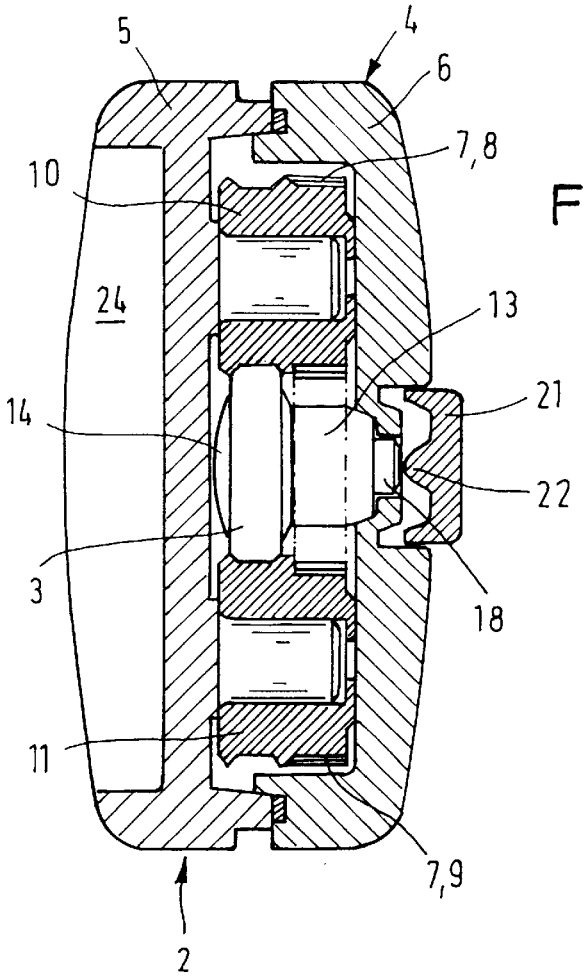
FIGS. 2 and 3 are two scaled-up cross-sections through the flat key represented in FIG. 1, taken along the lines designated therein as II—II and III—III.

In FIG. 1, 1 designates a flat key which is made up of a grip element 2 and a key bit 3. The grip element 2 includes a casing 4, into which the key bit 3 can be inserted and which consists of two shell-type casing halves 5, 6 (FIGS. 2 and 3) made of plastic, which are clipped together.

Arranged in the grip element casing 4 is a scroll spring 7 whose end zones 8, 9 are respectively wound spirally around two rollers 10, 11 arranged to the side of the key bit 3 and whose central zone 12 is guided around a peg-shaped element 13 of a head element 14 made of plastic and joined to the grip element casing 4. The key bit 3 rests laterally against the plastics rollers 10, 11.

The grip element casing 4 incorporates a slot-shaped recess 16 (FIG. 4) which extends in the direction of the longitudinal axis 15 of the key 1, into which recess 16 the peg-shaped element 13 projects and is guided in a positive manner when the key bit 3 is displaced. In addition, the peg-shaped element 13 possesses a recess 17 in which is mounted a displaceably arranged, spring-loaded pin 18 which in the two extreme positions of the key bit engages positively in a corresponding recess 19, 20 in the grip element casing 4.

The flat key 1 includes a rocker-type actuating element 21 arranged externally on the grip element casing 4, which element 21 in its two extreme zones incorporates projections 22, 23 directed towards the pin 18, said projections operating on the pin 18 in such a manner, when corresponding pressure is exerted, that said pin 18 can be pushed out of the respective recess 19, 20 in the grip element casing 4 and into the recess 17 in the peg-shaped element 13, with the result that the key bit 3 is either pushed into the grip element casing 4 by external pressure or out of the casing 4 by the pressure of the pretensioned scroll spring 7.

Figure 3:
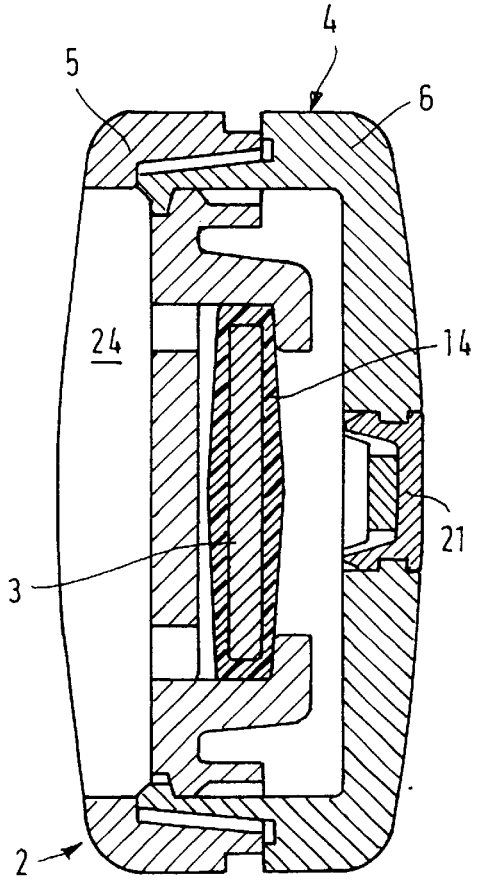
Figure 4:
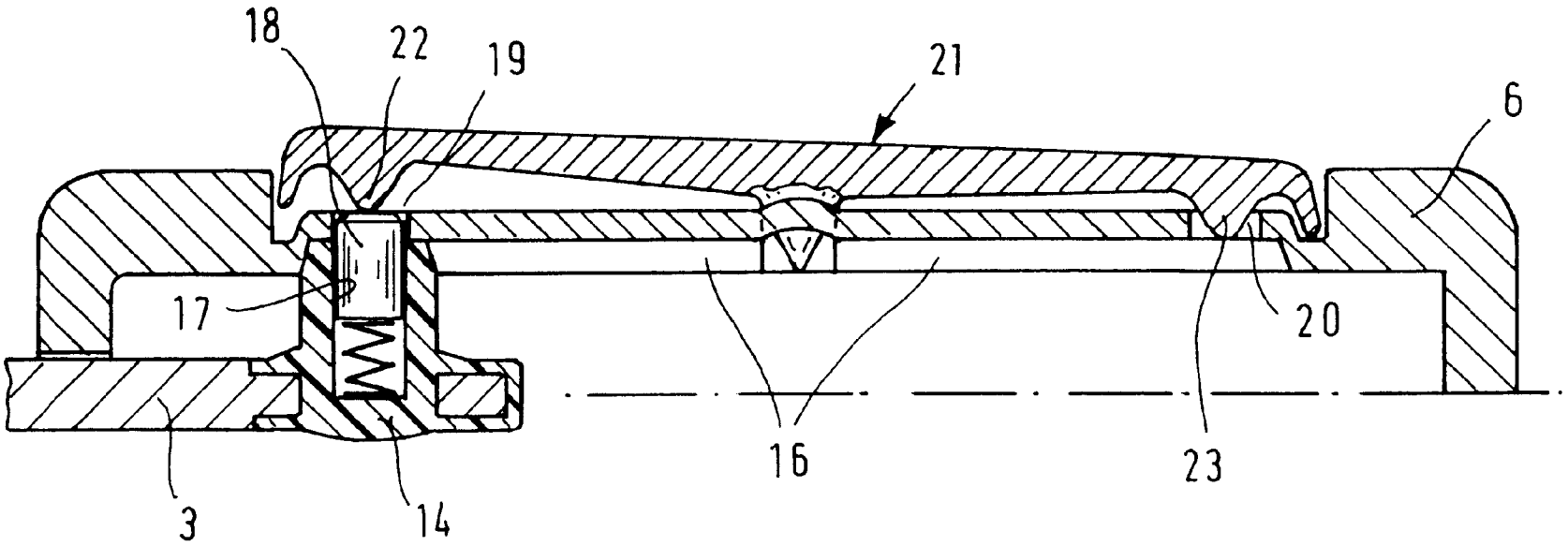
FIG. 4 shows the longitudinal section through the upper half of the flat key, rotated through 90° in relation to FIG. 1.

As will be immediately apparent from FIGS. 3 and 4, the key bit 3, the spring 7, the rollers 10, 11 and the actuating element 21 are secured in only one casing half 6, with the result that all the essential elements of the key 1 can be pre-assembled in said casing half in a straightforward manner. The respective other casing half 5 is used exclusively as a cover for sealing the grip element casing 4.

The cavity 24 formed between the casing halves 5 and 6 is of such a kind that in the case of an electronic locking system the electronic components that need to be arranged in the key can be accommodated in said cavity 24.

What is claimed is:

1. Flat key having a grip element (2) and a key bit (3), the grip element (2) including a casing (4) and the key bit (3) being arranged in a manner enabling said key bit (3) to be moved into and out of the grip element casing (4) and to be fixed in one of a first or a second extreme positions, and incorporating the following features:

a) the key bit (3) is mounted in the grip casing (4) in an axially displaceable manner;

b) arranged in the grip element casing (4) is a spring (7), a first and second ends (8, 9) of which are each wound spirally around two holders (10, 11) arranged at a side of the key bit (3) and a central zone (12) of which is arranged on a support (13) for an end of the key bit (3) that is situated inside the grip element casing (4), thereby uncoiling and thus tensioning the spring (7) when the key bit (3) is being inserted into the grip element casing (4).

2. Flat key according to claim 1, wherein said spring (7) is a scroll spring.

3. Flat key according to claim 1, wherein said spring holders (10, 11) are constructed as rollers against which said key bit (3) is supported laterally.

4. Flat key according to claim 2, wherein said rollers (10, 11) consist of at least one of rubber and plastic, at least in the ends in which said key bit (3) rests against said rollers.

5. Flat key according to claim 1, wherein said support (13) for said key bit (3) consists of a peg-shaped element about which the central zone (12) of the spring (7) is externally wound.

6. Flat key according to claim 5, wherein said grip element casing (4) incorporates a slot-shaped recess (16) extending in the longitudinal direction (15) of the key (1), into which recess (16) the peg-shaped element (13) projects and is guided in a positive manner as said key bit (3) is being displaced.

7. Flat key according to claim 4, wherein said peg-shaped element (13) incorporates a recess (17) in which there is mounted a displaceably arranged, spring-loaded pin (18) which in the first and second extreme positions of the key bit (3) engages positively in a corresponding recess (19, 20) in said grip element casing (4).

8. Flat key according to claim 5, wherein at least one actuating element (21) adapted to be pressed from the outside is arranged on said grip element (2), which actuating element (21) operates on said pin (18) in such a manner that when pressure is exerted on the actuating element (2) said pin (18) can be pushed out of the respective recess (19, 20) in said grip element casing (4) and into said recess (17) in the peg-shaped element (13), thereby rendering said key bit (3) axially displaceable.

9. Flat key according to claim 6, wherein said actuating element (21) is a rocker-shaped construction and in said ends incorporates projections (22, 23) directed towards said pin (18).

10. Flat key according to claim 1, wherein said grip element casing (4) consists of two shell-type casing halves (5, 6) adapted to be clipped onto one another, said key bit (3), said spring (7), said spring holder (10, 11) and said actuating element (21) being secured in only one casing half (6) and the respective other casing half (5) serving as a cover for sealing said grip element casing (4).

* * * * *